US008459628B2

(12) United States Patent
Adkins

(10) Patent No.: US 8,459,628 B2
(45) Date of Patent: Jun. 11, 2013

(54) NON-SLIP BENCH SUPPORT BLOCK

(75) Inventor: Edward D. Adkins, Rockford, IL (US)

(73) Assignee: Nomis LLC, Elgin, IL (US)

( * ) Notice: Subject to any disclaimer, the term of this patent is extended or adjusted under 35 U.S.C. 154(b) by 0 days.

(21) Appl. No.: 13/432,302

(22) Filed: Mar. 28, 2012

(65) Prior Publication Data

US 2012/0248674 A1 Oct. 4, 2012

Related U.S. Application Data

(63) Continuation of application No. 61/470,588, filed on Apr. 1, 2011.

(51) Int. Cl.
*B25B 11/00* (2006.01)

(52) U.S. Cl.
USPC ..... 269/289 R; 269/296; 269/48.1; 269/24; 269/32

(58) Field of Classification Search
USPC ..... 269/289 R, 296, 48.1, 24, 32, 45, 269/71, 75; 254/21, 93 R, 134; 248/224.8, 248/231.9; 446/120–122
See application file for complete search history.

(56) References Cited

U.S. PATENT DOCUMENTS

| | | | | | |
|---|---|---|---|---|---|
| 2,714,269 | A * | 8/1955 | Charles | 59/80 |
| 3,606,300 | A * | 9/1971 | Davis | 269/296 |
| 3,822,499 | A * | 7/1974 | De Vos | 446/121 |
| D233,203 | S * | 10/1974 | Hughes | D7/683 |
| 4,175,736 | A * | 11/1979 | Dietlein | 269/88 |
| 4,438,645 | A * | 3/1984 | Lutz | 72/481.1 |
| 4,465,268 | A * | 8/1984 | Hudson | 269/99 |
| 4,824,086 | A * | 4/1989 | Rickling et al. | 269/156 |
| 5,000,713 | A * | 3/1991 | Cheng | 446/120 |
| 5,286,951 | A * | 2/1994 | Jones | 219/521 |
| 5,419,534 | A * | 5/1995 | Vesely | 254/9 C |
| 5,531,625 | A * | 7/1996 | Zhong | 446/120 |
| 5,779,391 | A | 7/1998 | Knight | |
| 5,797,784 | A * | 8/1998 | Wolfe | 446/120 |
| 5,918,867 | A * | 7/1999 | Goodyear | 269/71 |
| 5,921,781 | A * | 7/1999 | Shaw | 434/298 |
| 6,286,812 | B1 * | 9/2001 | Cherry | 254/9 C |
| 6,308,943 | B1 * | 10/2001 | Fischer et al. | 269/32 |
| 6,702,273 | B1 * | 3/2004 | Sellers | 269/289 R |
| 7,910,188 | B2 | 3/2011 | Wheatley | |
| 8,336,868 | B2 * | 12/2012 | Wirth et al. | 269/289 R |
| 2003/0071406 | A1 * | 4/2003 | Sellers | 269/289 R |

(Continued)

OTHER PUBLICATIONS

Painter's Pyramid, Home Improvement, DIY Cool Tool, Save Time and Improve Results; known prior to Mar. 28, 2012; 3 pages; http://www.kandmofva.com/wood-products_copy.html.

(Continued)

*Primary Examiner* — George Nguyen
(74) *Attorney, Agent, or Firm* — Reinhart Boerner Van Deuren P.C.

(57) ABSTRACT

A work piece support device that includes a body and at least two portions of high-grip material on opposite sides of the body is provided. The body may have a flowable media stored therein to provide a lowered center of gravity depending on the orientation of the work piece support device. The work piece support device may include mating projections and recesses for coupling a plurality of work piece support devices together. Further, the projection can be in the form of a cone such that the work piece support device may function as a support cone.

17 Claims, 2 Drawing Sheets

U.S. PATENT DOCUMENTS

| | | | | |
|---|---|---|---|---|
| 2004/0150151 | A1 * | 8/2004 | Diermeier et al. | 269/289 R |
| 2006/0087067 | A1 * | 4/2006 | Shamoon | 269/289 R |
| 2007/0194186 | A1 | 8/2007 | Mars | |
| 2009/0283035 | A1 | 11/2009 | Bucci | |
| 2011/0121504 | A1 | 5/2011 | Krohmer et al. | |
| 2012/0068396 | A1 | 3/2012 | Wirth, Jr. et al. | |

OTHER PUBLICATIONS

Grabbers—Product Info; known prior to Mar. 28, 2012; 2 pages; http;//www.kandmofva.com/grabbers_productinfo.

Woodworker.com: Wolf Bench Paws; known prior to Mar. 28, 2012; 2 pages; http://woodworker.com/wolf-bench-paws-mssu-157-877.asp.

Bench Cookie™ Plus Work Grippers—Rockler Woodworking Tools; known prior to Mar. 28, 2012; 2 pages; http://www.rockler.com/product.cfm?page=30951.

Loc-Blocks form Peachtree Woodworking Supply; known prior to Mar. 28, 2012; 2 pages; http://www.ptreeusa.com/loc_blocks.htm.

* cited by examiner

NON-SLIP BENCH SUPPORT BLOCK

CROSS-REFERENCE TO RELATED PATENT APPLICATIONS

This patent application claims the benefit of U.S. Provisional Patent Application No. 61/470,588, filed Apr. 1, 2011, the entire teachings and disclosure of which are incorporated herein by reference thereto.

FIELD OF THE INVENTION

This invention generally relates to work-bench support tools and more specifically to non-slip work-bench support tools used to stabilize or support work pieces.

BACKGROUND OF THE INVENTION

It is often convenient to elevate a wooden work piece when doing activities such as painting, drilling or routing. A problem with elevating a work piece is that clamps are typically required to prevent the work piece from slipping while work is being performed on the work piece. The use of clamps can be time consuming to set-up as well as potentially damaging to the surface of the work piece that is being worked on.

The present invention is directed toward an improved work-bench support tool that improves upon one or more deficiencies in the art.

BRIEF SUMMARY OF THE INVENTION

In one embodiment, the invention provides a work piece support device having a body, a first portion of high grip material, a second portion of high grip material and a flowable media within the body is provided. The body defines an internal cavity. The first portion of high grip material is located on a first side of the body. The second portion of high grip material is located on a second side of the body, facing away from the first side. The flowable media is stored within the internal cavity. The flowable media adjusts the center of gravity of the work piece support device depending on the orientation of the body.

In one embodiment, the body is formed from three pieces including first and second caps and a frame. The first and second caps are attached to opposed ends of the frame. The internal cavity is formed between the frame and the first and second caps.

In one embodiment, the work piece support device has the first portion of high grip material attached to the first cap and the second portion of high grip material attached to the second cap.

In one embodiment, the work piece support device has a support point located axially between the first and second portions of high grip material.

In one embodiment, the work piece support device has a third portion of high grip material on a third side of the body. The third side of the body extends axially between the first and second sides.

In one embodiment, the work piece support device has a support point located on a fourth side of the body. Where the forth side is opposite the third side and extends axially between the first and second sides.

In one embodiment, the work piece support device includes a third side extending axially between the first and second sides. The third side includes a recess configured to mate with a support point of a second work piece support device.

In one embodiment, the invention provides a body with a first portion of high grip material on a first side of the body, and a second portion of high grip material on a second side of the body, facing away from the first side. A support point extends from a third side of the body, and the third side of the body extends axially between the first and second sides. This third side of the body has a support point receiving recess sized and configured to mate with a support point of a second work piece support device.

In one embodiment, the work piece support device has a third portion of high grip material on a fourth side of the body. The fourth side of the body extends axially between the first and second sides opposite the third side.

In one embodiment, a pair of work piece support devices each have a body; a first portion of high grip material on a first side of the body; a second portion of high grip material on a second side of the body, facing away from the first side; and a support point extending from a third side of the body, with the third side of the body extending axially between the first and second sides. Also, the body has a support point receiving recess sized and configured to mate with the support point of the other work piece support device.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
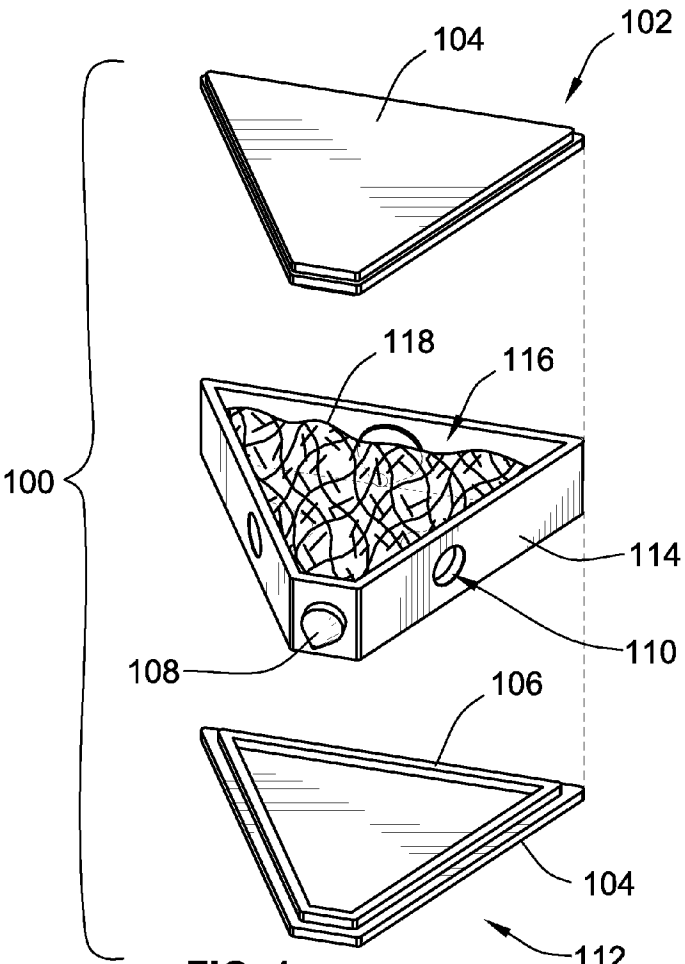
FIG. 1 is an exploded view of an embodiment of a work piece support device according to an embodiment of the invention.

FIG. 1 is an exploded illustration of an embodiment of a work piece support device 100 according to an embodiment of the present invention. The work piece support device 100 is used to support a work piece (not shown) such as a piece of wood that is to be cut, drilled, painted, or otherwise manipulated. Specifically, the work piece support device 100 of FIG. 1 includes a body generally provided by a first cap 102, a second cap 112, and a frame 114. The first and the second caps 102 and 112 are substantially identical in structure, and correspondingly fit into either side of the frame 114. The general structure may be molded plastic or any other material suitable for construction of the invention.

The first and second caps 102 and 112 fit into either end of the frame 114. The first and second cap 102 and 112 have a locating rib 106, as illustrated with reference to second cap 112. The outer peripheral shape of locating rib 106 corresponds to the inner peripheral shape of frame 114. The locating rib 106 extends axially into and seats within the cavity 116 formed and bounded by the sidewall portions of frame 114. This relationship ensures proper alignment between the first and second caps 102 and 112 and the frame 114. Alternatively, a plurality of holes and pegs could be provided between the first and second caps 102, 112 and frame 114 to locate the caps 102, 112 relative to frame 114.

The first and second caps 102, 112 may be adhesively secured to frame 114 using glue or other adhesives. The first and second caps 102, 112 could alternatively be ultrasonic welded to frame 114. Further yet, other means of securing the first and second caps 102, 112 to frame 114 could be implemented such as chemical bonding or mechanical catch arrangements to securely attach the first and second caps 102 and 112 to the frame 114. In a preferred embodiment, the first and second caps 102, 112 are sealingly attached to frame 114 such that internal cavity 116 is fully sealed.

In alternative embodiments, the locating rib 106 need not be a continuous rib, but could be a plurality of separate projections used to interact or engage the inner surface of the sidewalls of frame 114 to properly align the top and bottom caps 102, 112 relative to frame 114.

The frame 114 securely holds the first cap 102 and the second cap 112 and is of a similar geometric shape. The combination of frame 114 and first and second caps 102, 112 define and generally bound internal cavity 116 of the work piece support device 100. A flowable media or material 118, which may be composed of sand, granulized powder, beads of material, a liquid that is flowable at room temperature, etc, can be stored in internal cavity 116. Prior to sealing at least one of the first cap 102 or second cap 112 to the frame, the material 118 is placed in the cavity 116 formed by the frame 114 between the first and second caps 102 and 112. By using the flowable material 118, the center of gravity of the work piece support device 100 will adjust with the orientation of the device. This allows for lowering the center of gravity no matter the orientation of the work piece support device 100. Preferably, less than the entire volume of cavity 116 is filled with the flowable material 118 to allow for the adjustment in the center of gravity. Typically, 75% or less of the volume of the internal cavity 116 will be filled with the flowable media.

The frame 114 also has a support point or cone 108 and three receiving recesses or engagement holes 110 of reciprocating dimension to the cone 108. The cone 108 extends radially outward from a truncated corner of the frame 114. The cone 108 and engagement holes form mating male and female connections for coupling the work piece support device 100 with another work piece support device 100 (see e.g. FIG. 3).

As such, the engagement holes 110 are generally conical cavities formed in the corresponding sidewall portions of frame 114.

Figure 3:
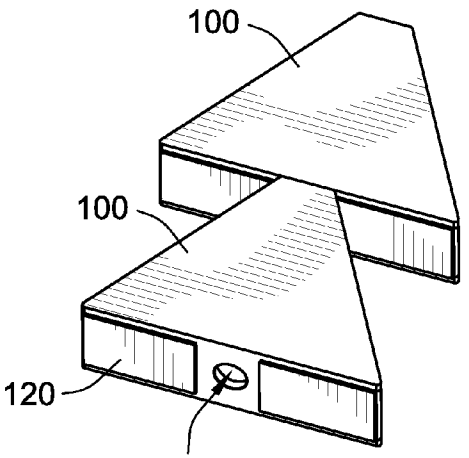
FIG. 3 shows an exemplary implementation of a plurality of work piece support devices of FIG. 1 interconnected together.

FIG. 3 illustrates a pair of work piece support devices 100 according to an embodiment of the invention in an engaged state. As illustrated, the work piece support devices 100 can be engaged to stabilize the two devices 100 relative to one another as well as to increase the surface area provided thereby. The cone 108 is inserted into engagement hole 110 of the second work piece support device 100.

As shown in FIG. 3, this allows multiple work piece support devices 100 to be daisy chained together to form a larger support structure thereby obtaining a greater surface for supporting different sized work pieces. The increased surface area will also decreases the chance that the work piece will slip relative to the work piece support devices 100 or the work piece support devices will slip relative to the bench, table or work surface supporting the work piece support devices 100.

Preferably, the outer surface of both the first and second caps 102 and 112 are covered in a layer of a high grip material such as a thermoplastic elastomer 104 (see FIG. 1), referred to generally as TPE. The layer of TPE 104 is applied to the outer surface of the first and second caps 102 and 112 to increase the gripping characteristics of the work piece support device 100 to prevent the work piece support device 100 from slipping when in contact with another object, and particularly the work piece or the surface supporting the work piece support device 100 such as a table or work bench. The layer of TPE 104 may be molded onto first and second caps 102, 112 or could be adhesively secured thereto. Further yet, mechanical fastening means could be used to secure the layer of TPE 104 to the first and second caps 102, 112.

Figure 2:
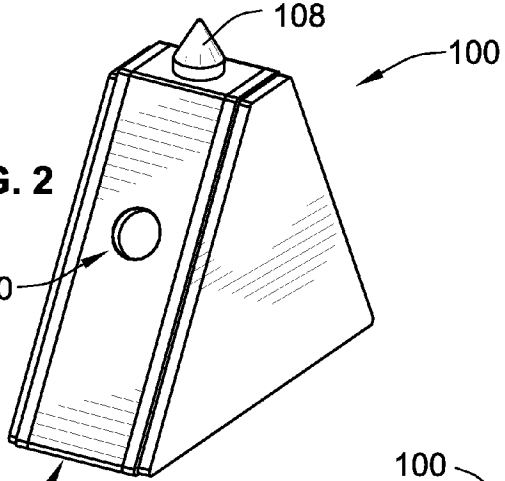
FIG. 2 is an assembled view of the work piece support device of FIG. 1.

A further feature of the work piece support device 100 is that it can also function as a support block 100 ideal for supporting a structure that is being painted. FIG. 2 shows a fully constructed work piece support device or support block 100 standing on one end, namely end 120 which is opposite the truncated end from which cone 108 extends. In operation, multiple work piece support devices 100 would be placed on end with the cone 108 pointing vertically upward to support a work piece. This provides a level surface ideal for painting the object resting on the work piece support devices 100. Additionally, the cone 108 comes to a point so that the work piece support device 100 only comes in contact with a minimal amount of the painted surface or surface to be painted.

The work piece support device 100 has TPE on at least three sides. TPE is on opposed sides of the work piece support device 100 defined by first and second caps 102, 112 that face axially away from one another. Further, the third side, provided by end 120, also includes TPE and is used when the work piece support device functions as a support block to elevate a work piece while painting. While not necessary, other embodiments can include TPE on the two sides that extend away from end 120.

Figure 4:
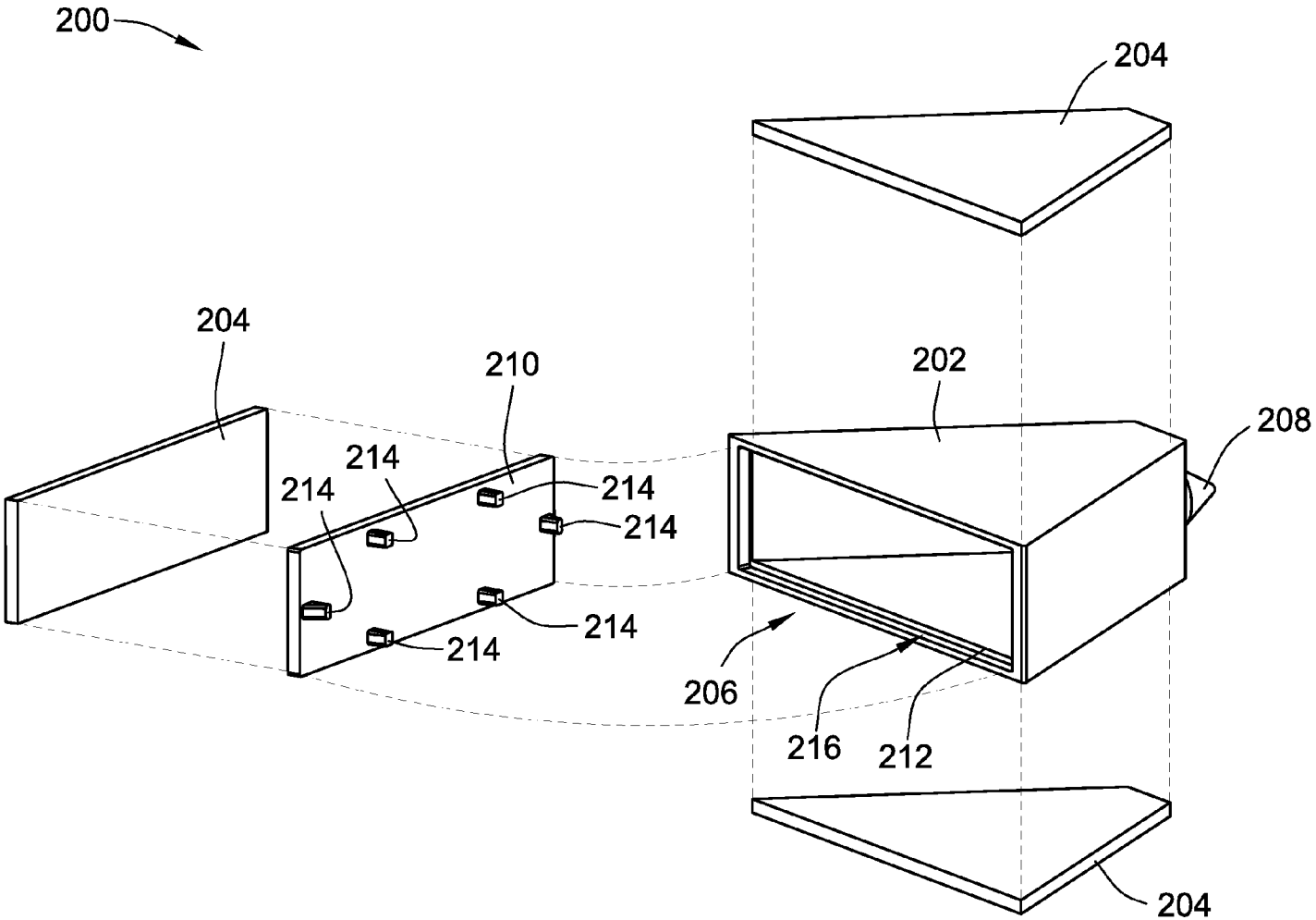
FIG. 4 is an exploded view an embodiment of the work piece support device according to another embodiment of the invention.

FIG. 4 illustrates an exploded view of another embodiment of the present invention of a work piece support device 200. Work piece support device 200 includes a frame in the form of a generally triangular shaped hollow body 202 that includes a frame opening 206 in the bottom of the body 202 where a single end cap 210 attaches to the body 202 to form an enclosed work piece support device 200 with an internal cavity. While not illustrated, the work piece support device includes a flowable material inside of the cavity formed by the body 202 and the end cap 210, similar to the work piece support device 100 discussed previously.

The end cap 210 includes guide pegs 214, which act to locate the end cap 210 into the opening 206. Specifically, the guide pegs 214 align with an inner flange surface 212 of the body 202. The inner flange surface 212 creates a sealing pocket 216 for the end cap 210. In one embodiment, the guide pegs 214 retain the end cap 210 inside of the sealing pocket 216 by having guide pegs 214 with a slanted outer surface. The slanted outer surface of the guide pegs engage the inner flange surface 212 such that when the end cap 210 is inserted into the opening 206 the guide pegs 214 assert a radially outward directed force on the inner flange surface 212 thereby holding the end cap 210 in place. In another embodiment, the guide pegs 214 merely act to guide the end cap 210 into the pocket 216 where an adhesive is applied to the pocket 216 to retain the end cap 210. And in an even further embodiment, both the guide pegs 214 with the slanted outer surface and the adhesive are used to retain the end cap 210 in the pocket 216.

Additionally, the work piece support device 200 includes a support point or cone 208, and is covered on three sides by a layer of TPE 204. The cone 208 provides an ideal surface useful for supporting a work piece while painting, similar to the cone 108 discussed previously. Also, the layer of TPE 204 provides a slip resistant surface covering for the work piece support device 200, similar to the TPE 104 discussed previously.

Furthermore, while the illustrated work piece support devices 100 and 200 are generally triangular, the invention is in no way intended to be limited to this geometric shape.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A work piece support device comprising:

a body defining an internal cavity;

a first portion of high grip material on a first side of the body;

a second portion of high grip material on an opposite second side of the body, facing away from the first side; and a flowable media stored within the internal cavity to adjust the center of gravity of the work piece support device depending on the orientation of the body.

2. The work piece support device of claim 1, wherein the body is formed from three pieces including first and second caps and a frame, the first and second caps attached to opposed ends of the frame, the internal cavity formed between the frame and the first and second caps.

3. The work piece support device of claim 2, wherein the first portion of high grip material is attached to the first cap and the second portion of high grip material is attached to the second cap.

4. The work piece support device of claim 1, further comprising a support point located axially between the first and second portions of high grip material.

5. The work piece support device of claim 4, further comprising a third portion of high grip material on a third side of the body, the third side of the body extending axially between the first and second sides.

6. The work piece support device of claim 5, wherein the support point is located on a fourth side of the body, the forth side being opposite the third side and extending axially between the first and second sides.

7. The work piece support device of claim 4, further including a third side extending axially between the first and second sides, the third side including a recess configured to mate with a support point of a second work piece support device.

8. The work piece support device of claim 7, wherein the support point is generally conical in shape.

9. The work piece support device of claim 1, wherein the high grip material is a thermoplastic elastomer.

10. The work piece support device of claim 1, wherein the flowable media is selected from the group consisting of sand, granulized powder, beads of material, and a liquid that is flowable at room temperature.

11. The work piece support device of claim 1, wherein the flowable media fills less than an entire volume of the internal cavity.

12. The work piece support device of claim 1, wherein the flowable media fills less than or equal to 75% of the internal cavity.

13. The work piece support device of claim 1, wherein the body is a frame structure with an opening on a single end, the opening is configured to receive an end cap, the internal cavity formed between the body and the end cap.

14. The work piece support device of claim 13, wherein the body includes an inner flange surface proximate the opening configured to create a sealing pocket.

15. The work piece support device of claim 14, wherein the end cap is configured to be inserted into the sealing pocket.

16. The work piece support device of claim 15, wherein adhesive retains the end cap in the sealing pocket.

17. The work piece support device of claim 15, wherein the end cap includes pegs that retain the end cap in the sealing pocket, the pegs include a slanted outer surface that creates a radially outward directed force on the inner flange surface when the end cap is pressed into the sealing pocket.

* * * * *